US007236718B2

(12) United States Patent
Rogers et al.

(10) Patent No.: US 7,236,718 B2
(45) **Date of Patent: *Jun. 26, 2007**

(54) PRINTER CARTRIDGE MODIFICATION

(75) Inventors: Justin Lee Rogers, Sanford, NC (US); James H. Jones, Fayetteville, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/440,914

(22) Filed: May 25, 2006

(65) Prior Publication Data

US 2006/0216059 A1 Sep. 28, 2006

Related U.S. Application Data

(63) Continuation of application No. 10/740,039, filed on Dec. 18, 2003, now Pat. No. 7,054,577.

(51) Int. Cl.
*G03G 15/00* (2006.01)
*G03G 15/08* (2006.01)

(52) U.S. Cl. ..... 399/109; 399/107; 399/119

(58) Field of Classification Search ..... 399/109, 399/107, 119

See application file for complete search history.

(56) References Cited

U.S. PATENT DOCUMENTS 5,261,326 A 11/1993 Michlin
5,729,795 A 3/1998 Kavolius et al.
6,219,506 B1 4/2001 Morinaga et al.
6,654,577 B1 11/2003 Hooper
6,801,734 B1 10/2004 Jones et al.
6,904,248 B2 * 6/2005 Daniels ..... 399/109
6,993,266 B2 1/2006 Daniels
7,054,577 B2 * 5/2006 Rogers et al. ..... 399/109
2004/0170445 A1 9/2004 Moore et al.
2005/0036801 A1 2/2005 Burchette
2005/0135836 A1 6/2005 Rogers et al.

FOREIGN PATENT DOCUMENTS

GB 2 389 196 A 3/2003

* cited by examiner

*Primary Examiner*—Susan Lee

(57) ABSTRACT

A modified printer cartridge is disclosed. In one aspect, the modified printer cartridge includes a waste bin including a first location where at least a portion of a shutter fin has been removed; and a new shutter fin attached to the waste bin at a second location, the second location differing from the first location, wherein, before the shutter fin was removed, the shutter fin was positioned to engage a shutter of a first type of printer, and wherein the new shutter fin is positioned to engage a laser shutter of a second type of printer.

3 Claims, 3 Drawing Sheets

PRINTER CARTRIDGE MODIFICATION

The present application is a continuation of allowed U.S. patent application Ser. No. 10/740,039 filed on Dec. 18, 2003 which is incorporated by reference herein in its entirety.

BACKGROUND

The present invention relates to remanufacturing and modifying printer cartridges, and more particularly to techniques for modifying a printer cartridge intended to operate in one type of printer to operate in another type of printer.

In the printing industry, there is a growing market for the remanufacture and refurbishing of various types of printing components such as toner cartridges, ink cartridges, magnetic rollers, seals, and the like. Toner cartridges, once spent, are unusable for their originally intended purpose. Without a refurbishing process, they would simply be discarded, even though the cartridge itself may still have potential life. As a result, techniques have been developed specifically to address this issue. These processes may entail, for example, the disassembly of the various structures of the cartridge, replacing toner, cleaning, adjusting or replacing any worn components and reassembling the cartridge.

The differences between printer cartridges for various types of printing devices may only be slight or subtle. In many instances it may only be an indentation or protuberance in the body of the cartridge. In other cases it may be not only a physical attribute of the body of the cartridge, but also the addition of a communications device. Certain style cartridges may be plentiful and relatively inexpensive simply because of certain factors such as the supply in the market or initial cost while other style cartridges may not be available in quantity or too expensive for cost effective use in remanufacturing. The easiest and most economic solution would be to simply convert the inexpensive style cartridges into the more costly style cartridge in order to meet this market demand.

SUMMARY

In accordance with an embodiment of the present invention, techniques are provided for modifying a printer cartridge intended to operate in one type of printer to operate in another type of printer.

In one aspect of the present invention, a method of modifying a toner cartridge intended for operation in a first type of printer to operate in a second type of printer includes removing at least a portion of an old laser shutter fin attached to the toner cartridge at a first location, and attaching a new laser shutter fin to the toner cartridge at a second location, with second location differing from the first location. The old laser shutter fin was positioned to engage a laser shutter of the first type of printer, and the new laser shutter is positioned to engage a laser shutter of the second type of printer.

In another aspect of the present invention, the method may include attaching a chip mounting patch to the toner cartridge, and attaching a computer chip to the chip mounting patch, with the computer chip being compatible with the second type of printer. In a preferred embodiment, the unmodified toner cartridge does not comprise a computer chip.

In another aspect of the present invention, the method includes replacing a first type of transfer gear of the toner cartridge with a second type of transfer gear, with first type of transfer gear for operation with the first type of printer and said second type of transfer gear for operation.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific techniques for converting an HP2100 toner printer cartridge for use in an HP2300 printer are disclosed. Other embodiments having different structures and operations for the conversion of other types of cartridges for use with other types of printers do not depart from the scope of the present invention. For example, the techniques of the present invention may be adapted to convert Canon FX-7 and Canon L50 toner cartridges for use in an HP2300 printer.

Figure 1:
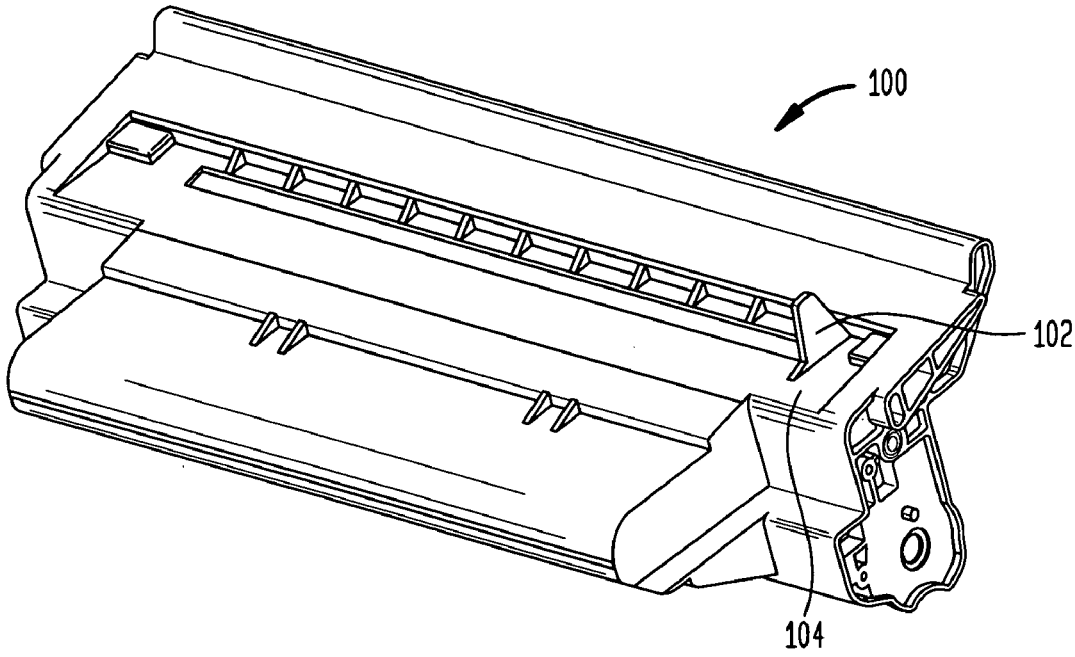
FIG. 1 (PRIOR ART)
FIG. 1 shows a perspective view of a prior art toner cartridge.

FIG. 1 shows a perspective view of a prior art toner cartridge 100, specifically an HP2100 toner cartridge. The toner cartridge 100 includes a laser shutter fin 102 attached to a waste bin 104. The laser shutter fin 102 is located in a predetermined position on the toner cartridge 100 in order to engage the laser shutter of an HP2100 laser printer when the toner cartridge 100 is installed in the laser printer. Without such engagement, the laser printer will not operate.

Other laser printers, such as the HP2300 laser printer, utilize a toner cartridge with many similarities, but also with a few important differences which prevent an unmodified HP2100 toner cartridge from operating in an HP2300 printer. In order to convert an HP2100 toner cartridge to an HP2300 compatible toner cartridge, certain modifications need to be made to the HP2100 toner cartridge to account for these differences.

Figure 2:
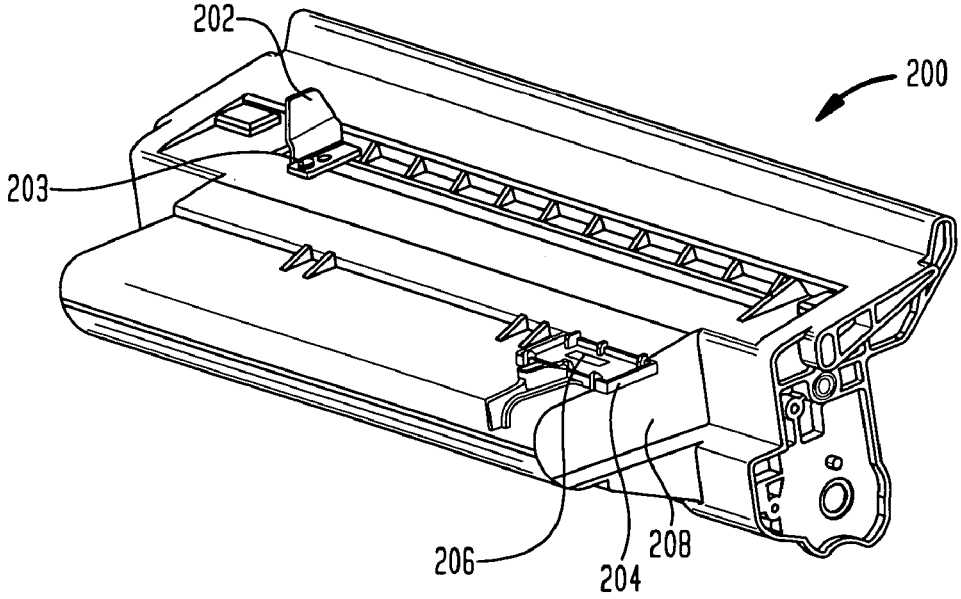
FIG. 2 shows a perspective view of a modified toner cartridge in accordance with the present invention.

FIG. 2 shows a perspective view of a modified toner cartridge 200 in accordance with the present invention. As described in greater detail below, the toner cartridge 200 may be an HP2100 toner cartridge which has been modified in order to allow the toner cartridge 200 to operate in an HP2300 printer. In one aspect of the present invention, a modification to the toner cartridge 100 involves removing the laser shutter fin 102 attached to the waste bin at a first location. Leaving the laser shutter fin 102 attached to the toner cartridge would interfere with the seating position of the toner cartridge 200 in an HP2300 printer. This removal may be accomplished by using a side cutter or the like. A replacement laser shutter fin 202 is attached to the toner cartridge 200 at a second location such that when the toner cartridge 200 is installed in an HP2300 printer the laser shutter fin 202 engages the laser shutter of the HP2300 printer. To correctly position the shutter fin 202, a template may be used to guide a drill to bore a screw hole for attaching the shutter fin 202. A screw 203 or other attachment device may be utilized to secure the shutter fin 202 to the toner cartridge 200 in the required location.

Figure 3:
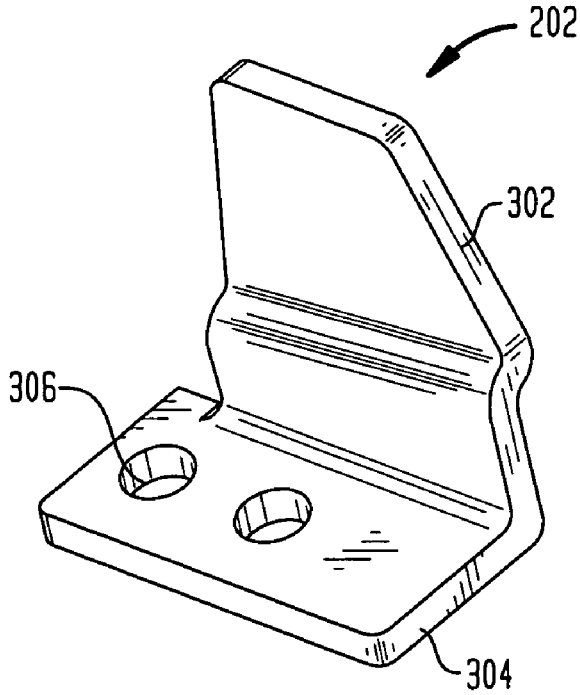
FIG. 3 shows a perspective view of a replacement fin in accordance with the present invention.

FIG. 3 shows a more detailed view of the shutter fin 202. The shutter fin 202 comprises an upright laser shutter engagement portion 302 and a mounting portion 304. The mounting portion 304 may include one or more holes 306 to facilitate attachment of the shutter fin 202 to the toner cartridge 200.

Figure 4:
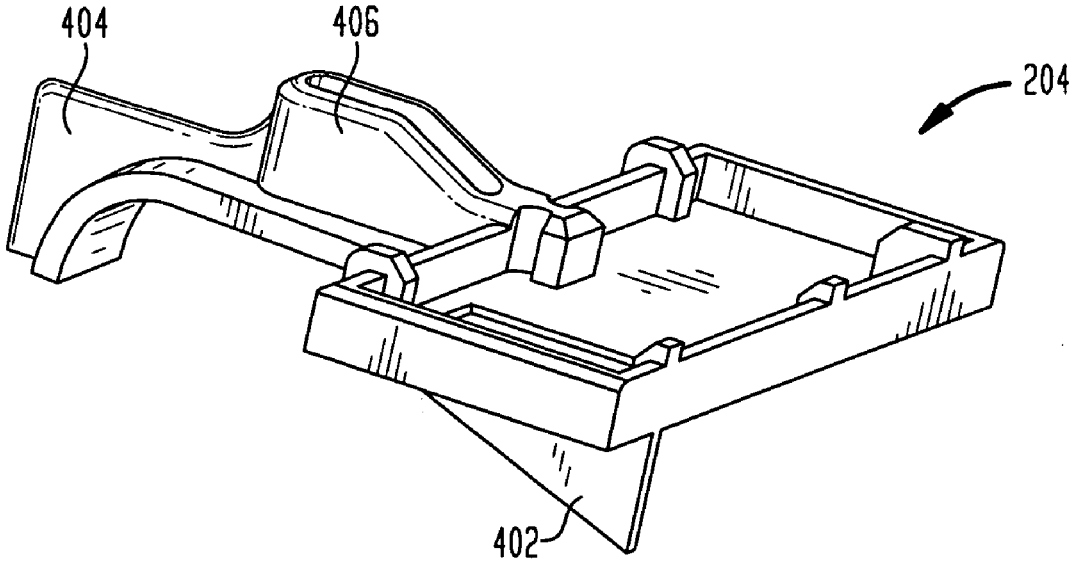
FIG. 4 shows a perspective view of a chip mounting patch in accordance with the present invention.

HP2300 toner cartridges include electronic chips having memory elements that communicate with the HP2300 printer to report toner levels and provide other functionality. These electronic chips are not utilized by HP2100 printers, and thus are not included with the prior art toner cartridge 100. In accordance with one aspect of the present invention, as shown in FIG. 2, a chip mounting patch 204 for holding an electronic chip 206 is attached to the toner cartridge 200. The electronic chip 206 may be an HP2300 compatible chip, such as the HP2300 smartek™ chip available from Static Control Components, Inc. The chip mounting patch 204 may be mounted on the toner cartridge 200 using adhesive or other suitable techniques. As seen more clearly in FIG. 4, the chip mounting patch 204 includes an alignment member 402 to insure the proper positioning of the chip mounting patch 204 upon installation. When the chip mounting patch 204 is installed, the alignment member 402 abuts the wall 208 of the toner cartridge 200. The chip mounting patch further comprises upright flanges 404 and 406 which engage with a chip contact device of the HP2300 printer and insure that the chip contact device has proper electrical contact with the chip 206 upon installation of the toner cartridge 200 into the HP2300 printer.

Figure 5:
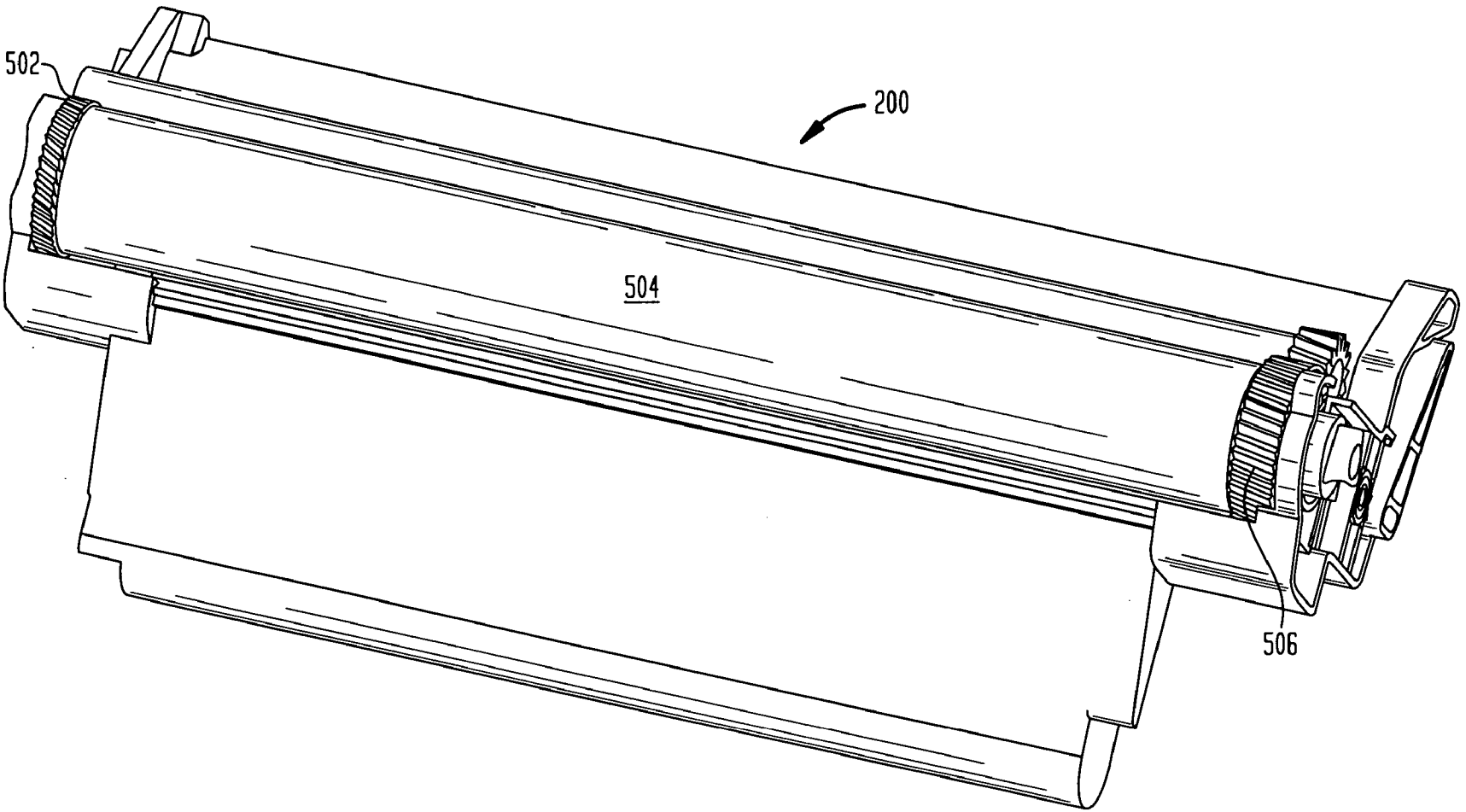
FIG. 5 shows a secondary view of a modified toner cartridge in accordance with the present invention.

In another aspect of the present invention, the drum assembly of the prior art toner cartridge 100 may be modified or replaced to be more compatible with an HP2300 printer. FIG. 5 shows a perspective view of an underside of the modified toner cartridge 200 in accordance with the present invention. The HP2100 straight spur transfer gear compatible with an HP2100 printer has been replaced with a new transfer gear 502 having a 10 degree helix angle. Alternatively, to facilitate ease of remanufacturing and modification, the drum assembly of the prior art toner cartridge may be replaced with a new drum assembly comprising the new transfer gear 502, an optical photo conductor (OPC) drum 504, and an HP2100 compatible helical OPC gear 506.

In another aspect of the present invention, HP2300 compatible toner may be loaded into the toner cartridge 200.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A modified toner cartridge comprising:

a waste bin including a first location where at least a portion of a shutter fin has been removed; and a new shutter fin attached to the waste bin at a second location, the second location differing from the first location, wherein, before the shutter fin was removed, the shutter fin was positioned to engage a shutter of a first type of printer, and wherein the new shutter fin is positioned to engage a laser shutter of a second type of printer, the modified toner cartridge further comprising:

a chip mounting patch attached to the toner cartridge; and an electronic chip attached to the chip mounting patch.

2. The modified toner cartridge of claim 1 wherein the electronic chip is adapted for operation with the second type of printer.

3. The modified toner cartridge of claim 2 wherein the chip mounting patch comprises at least one upright flange positioned to engage a chip contact device of the second type of printer.

* * * * *